US010643532B2

(12) United States Patent
Wang et al.

(10) Patent No.: US 10,643,532 B2
(45) Date of Patent: May 5, 2020

(54) DETECTING APPARATUS AND METHOD, REPAIRING APPARATUS AND METHOD, AND REPAIRING SYSTEM OF AMOLED DISPLAY DEVICE

(71) Applicants: BOE Technology Group Co., Ltd., Beijing (CN); Ordos Yuansheng Optoelectronics Co., Ltd., Ordos (CN)

(72) Inventors: Xiaowei Wang, Beijing (CN); Guoqing Zhang, Beijing (CN); Hongxia Yang, Beijing (CN); Weifeng Wang, Beijing (CN)

(73) Assignees: BOE Technology Group Co., Ltd., Beijing (CN); Ordos Yuansheng Optoelectronics Co., Ltd., Inner Mongolia (CN)

( * ) Notice: Subject to any disclaimer, the term of this patent is extended or adjusted under 35 U.S.C. 154(b) by 0 days.

(21) Appl. No.: 16/113,085

(22) Filed: Aug. 27, 2018

(65) Prior Publication Data

US 2019/0237013 A1 Aug. 1, 2019

(30) Foreign Application Priority Data

Jan. 31, 2018 (CN) ..... 2018 1 0094851

(51) Int. Cl.
*G09G 3/3233* (2016.01)
*G09G 3/3258* (2016.01)

(52) U.S. Cl.
CPC ..... *G09G 3/3233* (2013.01); *G09G 3/3258* (2013.01); *G09G 2330/08* (2013.01); *G09G 2330/10* (2013.01)

(58) Field of Classification Search
CPC ..... G09G 2330/08; G09G 2330/10; G09G 3/3233
See application file for complete search history.

(56) References Cited

U.S. PATENT DOCUMENTS 7,474,115 B1 * 1/2009 Trujillo ..... G09G 3/006 324/762.07
2014/0329339 A1 * 11/2014 Chaji ..... G01R 31/26 438/10

* cited by examiner

*Primary Examiner* — Chun-Nan Lin
(74) *Attorney, Agent, or Firm* — Fay Sharpe LLP

(57) ABSTRACT

A detecting apparatus and method, repairing apparatus and method, and repairing system of AMOLED display device are provided. The detecting apparatus includes: an illuminating device for sequentially illuminating a plurality of detection regions of a screen of the AMOLED display device, the screen being divided into the plurality of detection regions, each of the detection regions including at least one light-emitting unit; a current detecting device for acquiring a detection current which is a sum of driving currents of the light-emitting unit in the detection region being illuminated; and a judging device for judging whether the detection region corresponding to the detection current is a defective region according to the detection current. The apparatus can detect luminance uniformity of the AMOLED display device. The detection efficiency is high, the detection standard is unified and the detection accuracy is high.

16 Claims, 9 Drawing Sheets

DETECTING APPARATUS AND METHOD, REPAIRING APPARATUS AND METHOD, AND REPAIRING SYSTEM OF AMOLED DISPLAY DEVICE

This application claims priority to Chinese Patent Application No. 201810094851.5, filed with the State Intellectual Property Office on Jan. 31, 2018 and titled "DETECTING APPARATUS AND METHOD, REPAIRING APPARATUS AND METHOD, AND REPAIRING SYSTEM OF AMOLED DISPLAY DEVICE", the entire contents of which are incorporated herein by reference.

TECHNICAL FIELD

The present disclosure relates to a detecting apparatus and a method thereof, a repairing apparatus and a method thereof, and a repairing system of AMOLED display device.

BACKGROUND

An AMOLED (Active-matrix organic light-emitting diode) display device has the characteristics of low driving voltage, long operating life and high resolution, which is an OLED display device with huge potentials.

After the manufacture of an AMOLED display device is completed, it is need to detect the luminance of each region on its screen. The smaller the difference in luminance among regions on the screen of the AMOLED display device, the better the luminance uniformity of the screen of the AMOLED display device. If there is a region having an excessively high or low luminance on the screen, it is considered that the AMOLED display device has a Mura defect, i.e., the screen luminance is not uniform.

SUMMARY

There are provided in embodiments of the present disclosure a detecting apparatus and a method thereof, a repairing apparatus and a method thereof, and a repairing system of AMOLED display device.

There is provided in at least one embodiment of the present disclosure a detecting apparatus of an AMOLED display device, comprising: an illuminating device configured to sequentially illuminate a plurality of detection regions of a screen of the AMOLED display device, the screen being divided into the plurality of detection regions, each of the detection regions comprising at least one light-emitting unit; a current detecting device configured to acquire a detection current which is a sum of driving currents of the light-emitting units in the detection regions being illuminated; and a judging device configured to judge whether the detection region corresponding to the detection current is a defective region according to the detection current.

Optionally, the plurality of detection regions have any of the following formations: the plurality of detection regions are in a first direction, each of the detection regions being in a strip shape and extending in a second direction, and the second direction being perpendicular to the first direction; and the plurality of detection regions is in a matrix shape.

Optionally, the judging device comprises: a calculating circuit configured to calculate a ratio of the detection current to a current reference value which is one of a set value and an average value of the detection currents of the detection regions; and a judging circuit configured to determine whether the detection region is a defective region according to the ratio.

Optionally, the detecting apparatus further comprises: a storage device configured to store position information of the defective region that is determined.

Optionally, each of the detection regions comprises 4 to 8 pixel structures.

There is provided in at least one embodiment of the present disclosure a repairing apparatus of an AMOLED display device, configured to repair the defective region detected by the detecting apparatus of the AMOLED display device, comprising: a determining device configured to determine positions of the defective regions; an acquiring device configured to acquire a current density of a normal region when light-emitting unit in the normal region is illuminated, the normal region being a region other than the defective regions on the screen of the AMOLED display device; and a compensating device configured to perform current compensation on the defective regions based on the current density of the normal region.

Optionally, the determining device is configured to determine the position of the defective region in any of the following ways: determining the positions of the defective regions based on luminance of respective detection regions on the screen; determining the positions of the defective regions based on a ratio of detection current of respective detection regions to a current reference value, the screen being divided into a plurality of detection regions, the detection current being a sum of driving currents of light-emitting units in the detection regions being illuminated, and the current reference value being one of a set value and an average value of the detection currents of the detection regions; and determining the positions of the defective regions based on position information of the defective regions.

Optionally, the acquiring device is configured to calculate a ratio of a sum of driving currents of the light-emitting units in the normal region to an area of the normal region, so as to acquire the current density of the normal region.

Optionally, the compensating device comprises: a voltage determining unit configured to determine a data signal voltage of the defective regions based on a comparison relationship between the current density and the data signal voltage of the defective regions, such that the current density of the defective regions is equal to the current density of the normal region under effect of a correction voltage, the correction voltage being the data signal voltage of the defective regions being determined; and an entering unit configured to enter the correction voltage of the defective regions into a driver chip of the AMOLED display device.

There is provided in at least one embodiment of the present disclosure a detecting method of an AMOLED display device, comprising the following steps: sequentially illuminating a plurality of detection regions of a screen of the AMOLED display device, the screen being divided into the plurality of detection regions, each of the detection regions comprising at least one light-emitting unit; acquiring a detection current which is a sum of driving currents of the light-emitting units in the detection regions being illuminated; and judging whether the detection region corresponding to the detection current is a defective region according to the detection current.

Optionally, the plurality of detection regions have any of the following formations: the plurality of detection regions are in a first direction, each of the detection regions being in a strip shape and extending in a second direction, and the second direction being perpendicular to the first direction; and the plurality of detection regions is in a matrix shape.

Optionally, the step of judging whether the detection region corresponding to the detection current is the defective region according to the detection current includes: calculating a ratio of the detection current to a current reference value which is one of a set value and an average value of the detection currents of the detection regions; and determining whether the detection region is a defective region according to the ratio.

Optionally, the detecting method further comprises: storing position information of the defective regions being determined.

Optionally, each of the detection regions comprises 4 to 8 pixel structures.

There is provided in at least one embodiment of the present disclosure a repairing method of an AMOLED display device, configured to repair the defective region detected by the detection method for the AMOLED display device, comprising the following steps: determining positions of the defective regions; acquiring a current density of a normal region when the light-emitting unit in the normal region is illuminated, the normal region being a region other than the defective regions on the screen of the AMOLED display device; and performing current compensation on the defective region according to the current density of the normal region.

Optionally, the step of determining a position of the defective region is performed in any of the following ways: determining the positions of the defective regions based on luminance of respective detection regions on the screen; determining the positions of the defective regions based on a ratio of detection current of respective detection regions to a current reference value, the screen being divided into a plurality of detection regions, the detection current being a sum of driving currents of the light-emitting units in the detection regions that are illuminated, and the current reference value being one of a set value and an average value of the detection currents of the detection regions; and determining the positions of the defective regions based on position information of the defective regions.

Optionally, the step of acquiring a current density of a normal region comprises: calculating a ratio of a sum of driving currents of the light-emitting units in the normal region to an area of the normal region, so as to acquire the current density of the normal region.

Optionally, the step of performing current compensation on the defective region according to the current density of the normal region comprises: determining data signal voltage of the defective regions based on a comparison relationship between the current density and the data signal voltage of the defective regions, such that the current density of the defective regions is equal to the current density of the normal region under effect of a correction voltage which is the data signal voltage of the defective regions being determined; and entering the correction voltage of the defective regions into a driver chip of the AMOLED display device.

Optionally, the repairing method further comprises: performing a luminance uniformity detection on the AMOLED display device after performing the current compensation to the defective region based on the current density of the normal region.

There is provided in at least one embodiment of the present disclosure a repairing system of an AMOLED display device, comprising a detecting apparatus and a repairing apparatus, wherein the detecting apparatus comprises: an illuminating device configured to sequentially illuminate a plurality of detection regions of a screen of the AMOLED display device, the screen being divided into the plurality of detection regions, each of the detection regions comprising at least one light-emitting unit; a current detecting device configured to acquire a detection current, and the detection current is a sum of driving currents of the light-emitting units in the detection regions that are illuminated; and a judging device configured to judge whether the detection region corresponding to the detection current is a defective region based on the detection current; wherein the repairing apparatus comprises: a determining device configured to determine positions of the defective regions based on position information of the defective regions; an acquiring device configured to acquire a current density of a normal region when the light-emitting unit in the normal region is illuminated, the normal region being a region other than the defective regions on the screen of the AMOLED display device; and a compensating device configured to perform current compensation on the defective regions based on the current density of the normal region.

DETAILED DESCRIPTION

The embodiments of the present disclosure will be described in further detail with reference to the enclosed drawings, in order to present the principles and advantages of the present disclosure more clearly.

Figure 1:
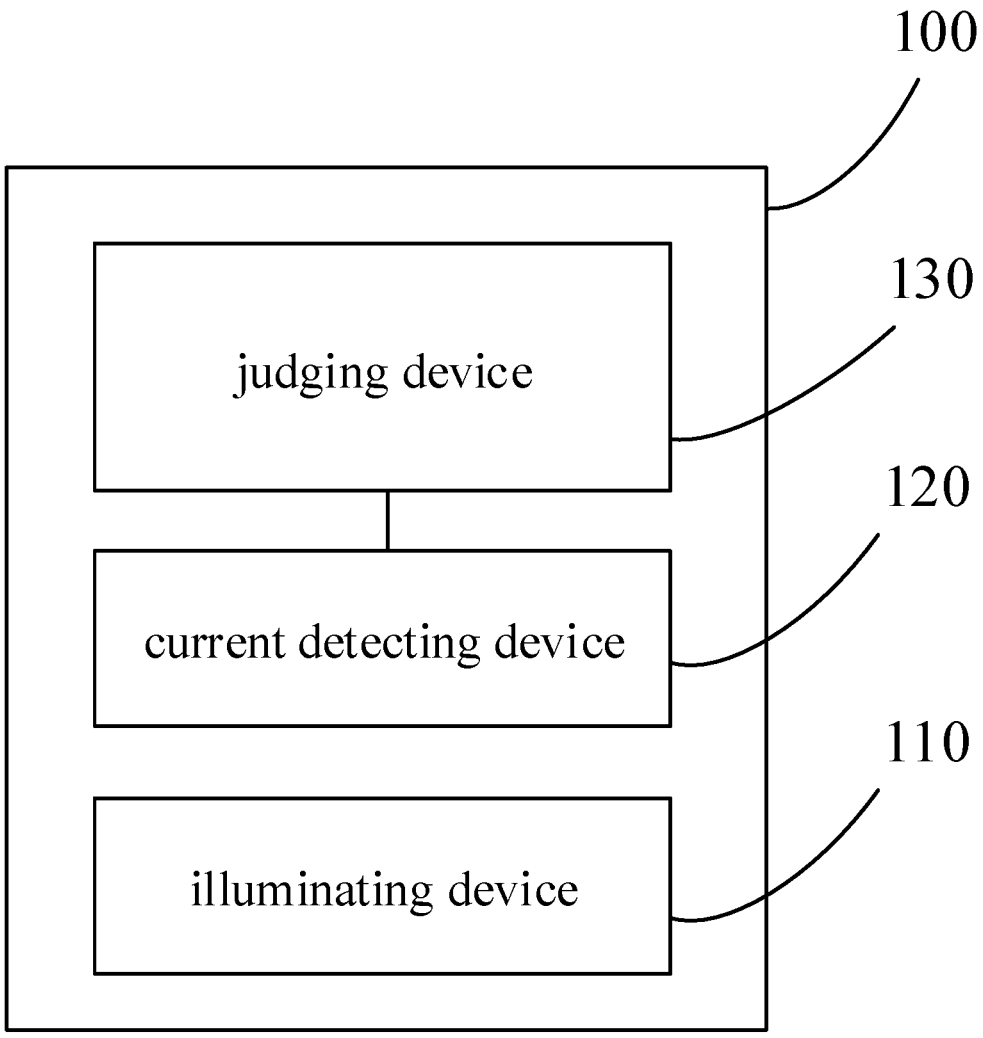
FIG. 1 is a schematic diagram of a structure of a detecting apparatus of an AMOLED display device according to an embodiment of the present disclosure.

FIG. 1 is a schematic diagram of a structure of a detecting apparatus of an AMOLED display device provided in an embodiment of the present disclosure. As shown in FIG. 1, the detecting apparatus 100 comprises an illuminating device 110, a current detecting device 120 and a judging device 130.

Here, the screen of the AMOLED display device is divided into a plurality of detection regions. The illuminating device 110 is configured for sequentially illuminating the plurality of detection regions of the screen of the AMOLED display device. The current detecting device 120 is configured for acquiring a detection current, and the detection current is a sum of driving currents of light-emitting units in the illuminated detection region (the filled detection region in FIG. 2 or FIG. 3). The judging device 130 is configured for judging whether a detection region 201 corresponding to the detection current is a defective region according to the detection current. Here, the detection region 201 corresponding to the detection current refers to a detection region which is illuminated when the detection current is acquired.

At present, the luminance detection of the AMOLED display device is mainly realized via visual detection by workers. The worker feels the luminance of the screen, and judges whether the OLED display device has a problem of Mura defect. Such a detection method is not only inefficient, but also subjected to subjective views. Testing the same AMOLED display device by different workers may result in different testing results and reduced product yield, and the detected defect is hard to be repaired. In the embodiments of the present disclosure, the luminance uniformity of the AMOLED display device can be detected by dividing the screen of the AMOLED display device into a plurality of detection regions, sequentially illuminating the detection regions and acquiring detection currents of the detection regions, and judging whether a detection region is a defective region according to the detection current, thereby achieving high detection efficiency, unified standard and high accuracy, reducing the misjudgments, and facilitating the improvement of product yield.

Exemplarily, the illuminating device 110 can be a lighting machine. The current detecting device 120 can be a current sensor. The current sensor is connected at a joint between the lighting machine and the display device so as to acquire a total driving current output to the AMOLED display device when a certain region is illuminated by the lighting machine, and this current is the detection current of the corresponding region. Besides, for a lighting machine that has a function of detecting a magnitude of an output current, the driving current output from the lighting machine to the display device can also be acquired directly by the lighting machine. After the detection current is acquired by the current detecting device 120, a value of the detection current of each detection region can be recorded to facilitating the subsequent applications, thereby avoiding repeated acquirements of the current value, which is beneficial for improving the detection efficiency.

Figure 2:
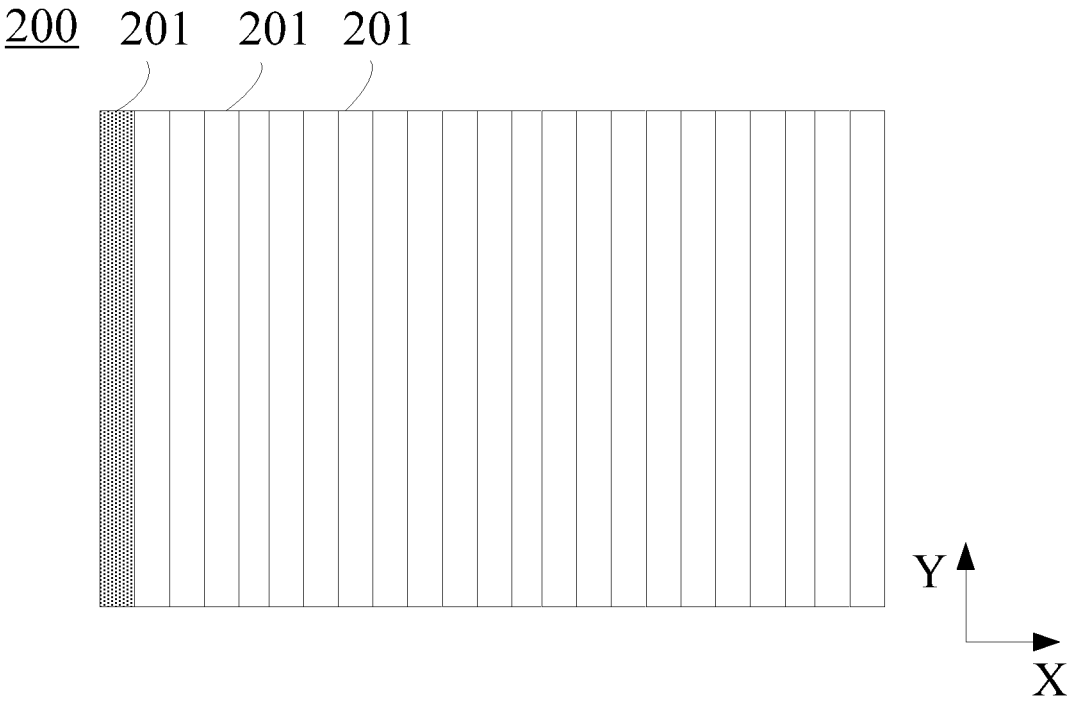
FIG. 2 is a diagram of a distribution of detection regions of a screen of an AMOLED display device according to an embodiment of the present disclosure.

FIG. 2 is a diagram of a distribution of detection regions of a screen of an AMOLED display device provided in an embodiment of the present disclosure. As shown in FIG. 2, the screen 200 is divided into a plurality of detection regions 201, each of which includes at least one light-emitting unit. As shown in FIG. 2, the plurality of detection regions 201 are arranged in a first direction (such as X direction in FIG. 2), each of the detection regions 201 is in a strip shape and extends in a second direction (such as Y direction in FIG. 2) perpendicular to the first direction.

When the detection regions 201 in FIG. 2 are sequentially illuminated by the illuminating device 110, a first detection region in the first direction can be illuminated first, that is, all the light-emitting units in the first detection region are illuminated, while the other detection regions are remained lighting off, that is, all of the light-emitting units in the other detection regions are in an lighting-off state; then a second detection region is illuminated, and all the other detection regions except the second detection region are remained in an lighting-off state; and thereafter a third detection region is illuminated, and all the other regions except the third detection region are remained in an lighting-off state. As such, the detection regions are sequentially illuminated.

The screen of the AMOLED display device includes a plurality of light-emitting units distributed in an array. Here, the first direction can be a row direction of the light-emitting units distributed in the array, the second direction can be a column direction of the light-emitting units distributed in the array, Alternatively, the first direction can also be a column direction and the second direction can be a row direction.

Figure 3:
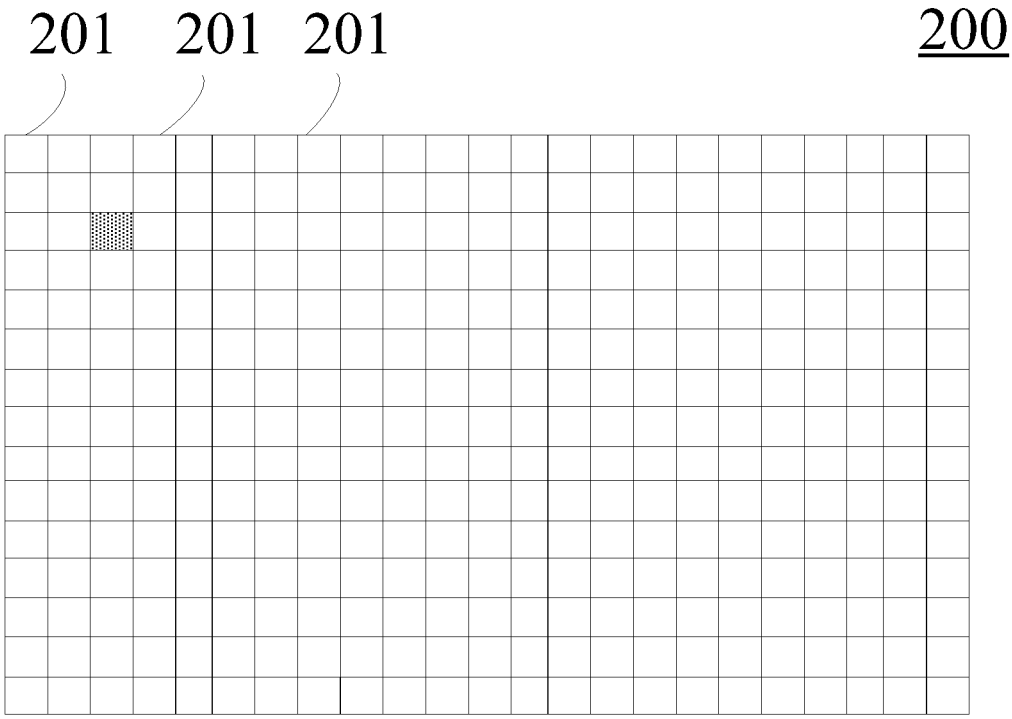
FIG. 3 is a diagram of a distribution of detection regions of a screen of an AMOLED display device according to an embodiment of the present disclosure.

FIG. 3 is a diagram of a distribution of detection regions of a screen of an AMOLED display device provided in an embodiment of the present disclosure. The filled region in this figure is a region that is currently illuminated by the aforementioned illuminating device. As shown in FIG. 3, the plurality of detection regions 201 are arranged in a matrix shape.

When the detection regions 201 in FIG. 3 are sequentially illuminated by the illuminating device 110, a first detection region in the first row can be illuminated first while the other detection regions are remained in a light-off state; then a second detection region in the first row is illuminated and all the other detection regions except the second region in the first row are remained in a light-off state; and thereafter a third detection region in the first row is illuminated and all the other detection regions except the third detection region in the first row are remained in a light-off state. As such, the detection regions are sequentially illuminated.

The entire screen 200 is divided into a plurality of detection regions 201, so that the entire screen 200 can be detected. Different dividing methods can be employed during implementation according to actual needs. The more the number of the divided detection regions, the higher the accuracy of the detection.

For example, for a display device with a screen length-width ratio of 24:9 or more, since the screen length-width ratio of such a display device is relatively large, the number of light-emitting units in a length direction of the screen is much greater than that in a width direction of the screen, and thus a large luminance difference is more likely to occur among different regions in the length direction. When such a display device is detected, it can be divided into a plurality of strip-shaped detection regions in the length direction of the screen, each of which extends in the width direction of the screen (such as the dividing method shown in FIG. 2). Of course, if the requirement for the screen display effect is relatively high, then the screen can also be divided into a plurality of detection regions which are arranged in a matrix shape (such as the dividing method shown in FIG. 3).

When the screen size is constant, the larger the detection region is, the smaller the total number of the divided detection regions is, and the fewer the corresponding detection times are. At this point, the detection accuracy is low and the detection efficiency is high. On the contrary, the smaller the detection region is, the greater the total number of the divided detection regions is, and the more the corresponding detection times are. At this point, the detection accuracy is high and the detection efficiency is low. When the detection regions are divided, the size of the detection region can be set according to different requirements. For a display device with a higher requirement for display effect, the detection regions can be set to be smaller. For a display device with a lower requirement for display effect, the detection regions can be set to be larger.

Exemplarily, each detection region can include 4 to 8 pixel structures. The pixel structures of different display devices can include different numbers of light-emitting units. For example, a single pixel structure can include three light-emitting units. A single pixel structure of a certain kind of display device includes a light-emitting unit that emits red light, a light-emitting unit that emits green light and a light-emitting unit that emits blue light. When the detection regions of such a display device are divided, if each detection region includes 4 pixel structures, then each detection region includes 12 light-emitting units.

The smaller the detection region is, the fewer the number of the light-emitting units in the detection region is. When the detection region is so small that it only includes one light-emitting unit, it is equivalent to that the light-emitting units are detected one by one. As such, the detection result is the most accurate, but correspondingly the detection efficiency is the lowest, and the detection cost is also high. In general, the size of each detection region is set to be a size of 4 to 8 pixel structures, so that the detection result has relatively high accuracy to satisfy the detection requirement.

Figure 4:
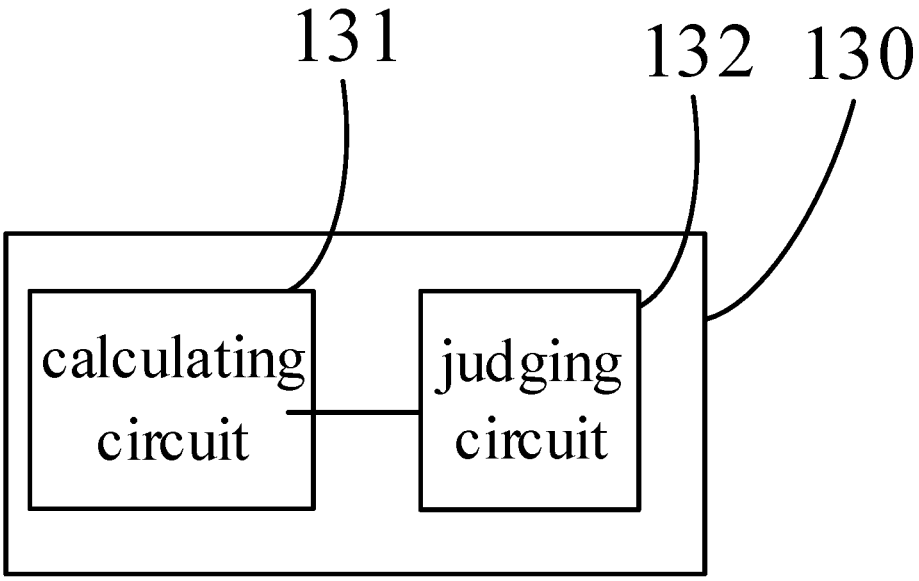
FIG. 4 is a schematic diagram of a structure of a judging device according to an embodiment of the present disclosure.

FIG. 4 is a schematic diagram of structure of a judging device provided in an embodiment of the present disclosure. As shown in FIG. 4, the judging device 130 may include a calculating circuit 131 and a judging circuit 132. The calculating circuit 131 is configured for calculating a ratio of a detection current to a current reference value, and the current reference value is one of a set value and an average value of the detection currents of the detection regions. The judging circuit 132 is configured for determining whether a detection region 201 is a defective region according to the ratio. A luminance of the light-emitting unit is related to a magnitude of the driving current of the light-emitting unit. The greater the driving current is, the higher the luminance is. On the contrary, the smaller the driving current is, the lower the luminance is. According to the ratio of the detection current to the current reference value, it is determined whether a detection region 201 is a defective region, such that a region having a great different in luminance can be accurately detected.

When the current reference value is an average value of the detection currents of the detection regions, if the detection current is closer to the current reference value, i.e., the ratio is more approximate to 1, this indicates that the luminance of the detection region is closer to the average luminance of the detection regions. The smaller the luminance difference between different detection regions is, the more uniform the screen luminance is.

The set value can be set according to design requirements. For example, a corresponding set value can be set in accordance with a luminance requirement of a designed display device. If the detection current is closer to the current reference value, i.e., the ratio is more approximate to 1, this indicates that the luminance of the detection region is closer to a required luminance. If the detection current of respective detection region is close to the current reference value, the smaller the luminance difference between different detection regions is, the more uniform the screen luminance is.

Exemplarily, when the ratio is within a range of 0.9 to 1.1, the corresponding detection region can be regarded as a normal region, and when the ratio is less than 0.9 or greater than 1.1, the corresponding detection region can be regarded as a defective region. In practice, it is hard to ensure that the detection current of the detection region is completely equal to the current reference value, so when the ratio is within a certain range, the detection region can be regarded as a normal region. The range of the ratio can be set according to different design requirements. For a display device with a higher design requirement, the range of the ratio can be set to be smaller, such as 0.95 to 1.05, and for a display device with a lower design requirement, the range of the ratio can be set to be larger, such as 0.8 to 1.2.

Exemplarily, it is also possible to determine whether each detection region is a defective region according to an absolute value of a difference between the detection current and the current reference value. When the absolute value of the difference between the detection current and the current reference value is smaller, the luminance of the detection region is closer to the luminance of the other detection regions, and the smaller the luminance difference between different detection regions is, the more uniform the screen luminance is.

Optionally, the detecting apparatus can also comprise a storage device. The storage device is configured for storing position information of the determined defective region, so as to facilitate acquirement of a position of the defective region when the defective region is repaired. The position information can be a virtual coordinate, which can be a one-dimensional coordinate or a two-dimensional coordinate. For example, if the filled region in FIG. 2 is a defective region, then the virtual coordinate (one-dimensional coordinate) of the defective region can be recorded as 1; if a detection region adjacent to the filled region is a defective region, then the virtual coordinate of the defective region can be recorded as 2. If the filled region in FIG. 3 is a defective region, then the virtual coordinate (two-dimensional coordinate) of the defective region can be recorded as (3, 3). In addition, the position information can also be a number. For example, if the plurality of detection regions divided on the screen are respectively numbered, then the position information of the defective region is the number corresponding to the defective region.

Figure 5:
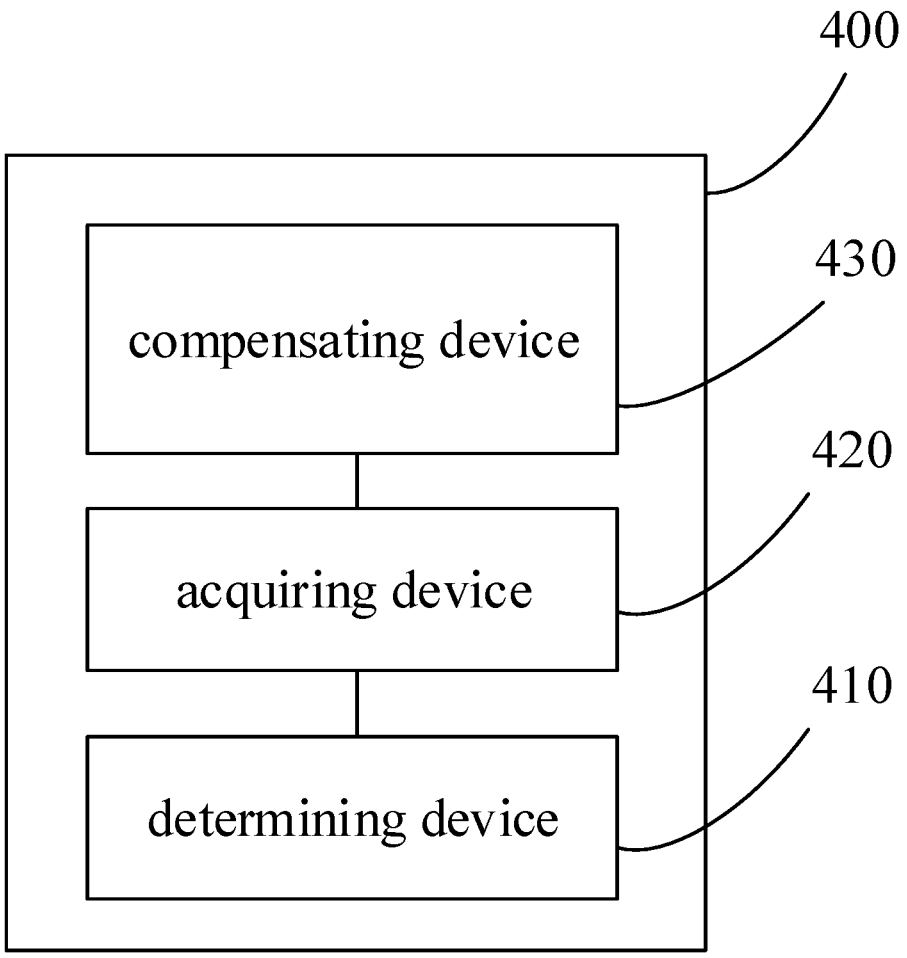
FIG. 5 is a repairing apparatus of an AMOLED display device according to an embodiment of the present disclosure.

FIG. 5 is a repairing apparatus of an AMOLED display device provided in an embodiment of the present disclosure. The apparatus is configured to repair the defective region of the screen of the AMOLED display device in which a Mura defect is present. As shown in FIG. 5, the repairing apparatus 400 comprises a determining device 410, an acquiring device 420 and a compensating device 430. The determining device 410 is configured for determining a position of the defective region. The acquiring device 420 is configured for acquiring a current density of a normal region when a light-emitting unit of the normal region is illuminated. The compensating device 430 is configured for performing current compensation on the defective region according to the current density of the normal region. The normal region is the region other than the defective region on the screen.

The current compensation to the defective region of a display device can be performed according to the current density of the normal region, thereby changing the luminance of the defective region and reducing a luminance difference between the defective region and the normal region, which is beneficial for improving the display effect and the yield.

The current density referred to in the present disclosure is a ratio of a sum of driving currents, when all the light-emitting units in a certain region on the screen of the AMOLED display device are illuminated, to an area of the region. For example, the current density of the normal region is a ratio of a sum of driving currents when all the light-emitting units in the normal region are illuminated to an area of the normal region. The area of each region can be represented by a size of a plane enclosed by a profile of the region, and the unit can be square millimeter and square centimeter, etc. For example, the current density of a certain region is 3 $mA/mm^2$. In addition, since the distribution of the light-emitting units on the screen is generally uniform, the area of each region can also be represented as the number of the light-emitting units in the region, and the unit can be one light-emitting unit. For example, the current density of a certain region is 5 mA per light-emitting unit.

In an implementation of embodiments of the present disclosure, the determining device 410 can be configured to determine the position of the defective region according to the luminance of each region on the screen. Exemplarily, the luminance detection can be performed on each region of the screen through a luminance meter, so as to determine the position of each defective region. For example, only one detection region is illuminated each time, and then the luminance value of the region is detected through the luminance meter, so that luminance values of all the detection regions can be detected. A detection region in which a difference between the detected luminance value and an average luminance value or a difference between the detected luminance value and a set luminance value is beyond a certain range is a defective region.

In another implementation of embodiments of the present disclosure, the determining device 410 can also be configured to determine the position of the defective region according to a ratio of the detection current of each detection region to the current reference value. The screen is divided into a plurality of detection regions, the detection current is a sum of driving currents of the light-emitting units in the detection region which is illuminated, and the current reference value is one of a set value and an average value of the detection currents of the detection regions. In an implementation, the display device can be detected by using the aforementioned detecting apparatus of an AMOLED display device, so as to determine the position of each defective region on the screen.

In another implementation of embodiments of the present disclosure, the determining device 410 can also be configured to determine the position of the defective region according to position information of the defective region. The determining device 410 can directly acquire position information of each defective region through the aforementioned storage device, so as to find the position of each defective region rapidly and accurately in the repair process, thereby improving the repair efficiency while avoiding omissions of repair.

Figure 6:
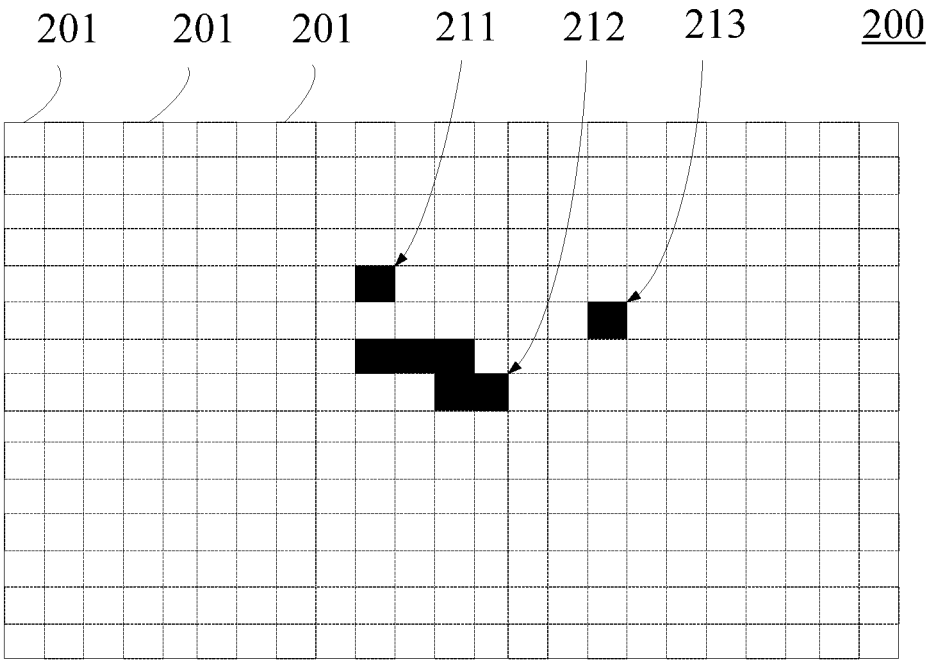
FIG. 6 is a schematic diagram of a distribution of defective regions of the screen of the AMOLED display device shown in FIG. 3.

FIG. 6 is a schematic diagram of a distribution of poor regions of the screen of the AMOLED display device shown in FIG. 3. Each dashed box in the figure represents a detection region. As shown in FIG. 6, after the detection, there are 7 defective regions on the screen 200, and the 7 defective regions are shown as black detection regions in FIG. 6, in which 5 defective regions are connected. After the detection has been completed, the position of each region can be recorded in a form of virtual coordinate, for example, a virtual coordinate of the detection region in row 5, column 10 can be recorded as (10, 5).

The acquiring device 420 can be configured to calculate a ratio of a sum of driving currents of the light-emitting units in the normal region to an area of the normal region, so as to acquire the current density of the normal region. In FIG. 6, the normal region is a region composed of all white detection regions.

Take the plurality of regions shown in FIG. 6 as an example, a sum of driving currents of the light-emitting units of the defective region 211 is I1, a sum of driving currents of the light-emitting units of the defective region 212 is I2, and a sum of driving currents of the light-emitting units of the defective region 213 is I3, thus a current density of the defective region 211 is I1/S0, a current density of the defective region 212 is I2/S0, and a current density of the defective region 213 is I3/S0. Here, the defective region 212 shown in FIG. 6 is one of the 5 defective regions that are connected. A sum of driving currents of the light-emitting units of the normal region is I0, and the current density of the normal region is I0/(S1−7S0). Here, S0 is an area of each detection region 201, and S1 is a sum of the areas of all the detection regions 201.

The sum of driving currents of the light-emitting units of the normal region can be acquired by using the aforementioned current detecting device in the detecting apparatus of the AMOLED display device. For example, the sum of driving currents of the light-emitting units of the normal region can be acquired by illuminating only the normal region. Exemplarily, the aforementioned illuminating device can be configured to illuminate the normal region, and the sum of driving currents of the light-emitting unit of the normal region can be detected by using the current detecting device. Alternatively, the entire screen can also be illuminated, and a sum of driving currents of all the light-emitting units can be acquired when the entire screen is illuminated, then I0 can be acquired by subtracting I1, I2 and I3 from the sum.

In addition, the detection current of each detection region can also be recorded when detections are performed by using the aforementioned detecting apparatus, and a sum of detection currents of the detection regions in the normal region the I0.

Figure 7:
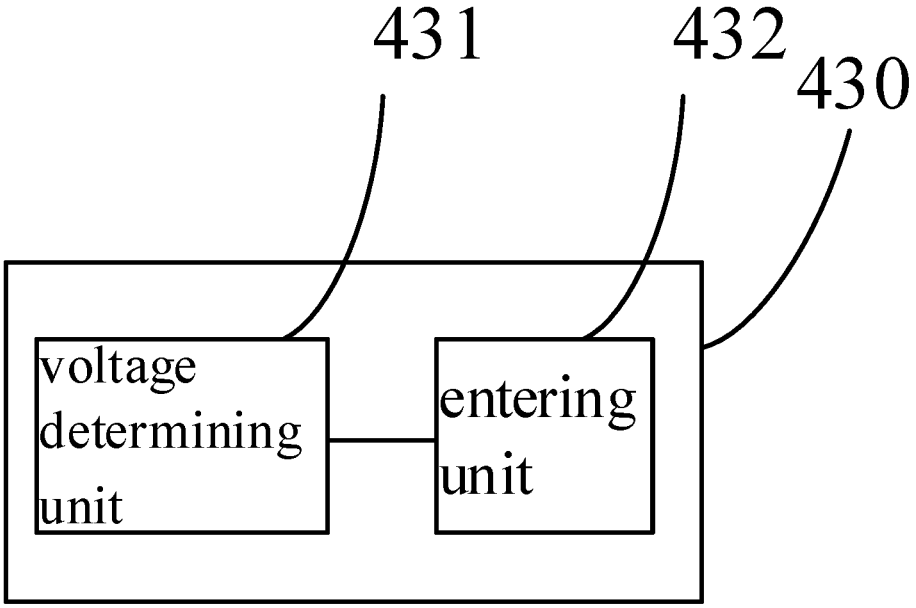
FIG. 7 is a schematic diagram of a structure of a compensating device according to an embodiment of the present disclosure.

FIG. 7 is a schematic diagram of a structure of a compensating device provided in an embodiment of the present disclosure. As shown in FIG. 7, the compensating device 430 may include a voltage determining unit 431 and an entering unit 432. The voltage determining unit 431 is configured to determine a data signal voltage of a defective region according to a comparison relationship between the current density and the data signal voltage of the defective region, so that the current density of the defective region can be equal to that of the normal region under the action of a correction voltage. Here, the correction voltage is the data signal voltage of the determined defective region. The entering unit 432 is configured to enter the correction voltage of the defective region into a driver chip of the AMOLED display device. By adjusting the data signal voltage of each light-emitting unit of the defective region to a correction voltage, the current density of the defective region can be changed, and the current density of the defective region can be equal to that of the normal region. For example, before repair, the current density of a certain defective region is smaller than that of the normal region; and after repair, the data signal voltage of the defective region is adjusted to be the determined data signal voltage, i.e., the correction voltage, thus the current density of the defective region after the adjustment is increased to be the current density of the normal region.

Figure 8:
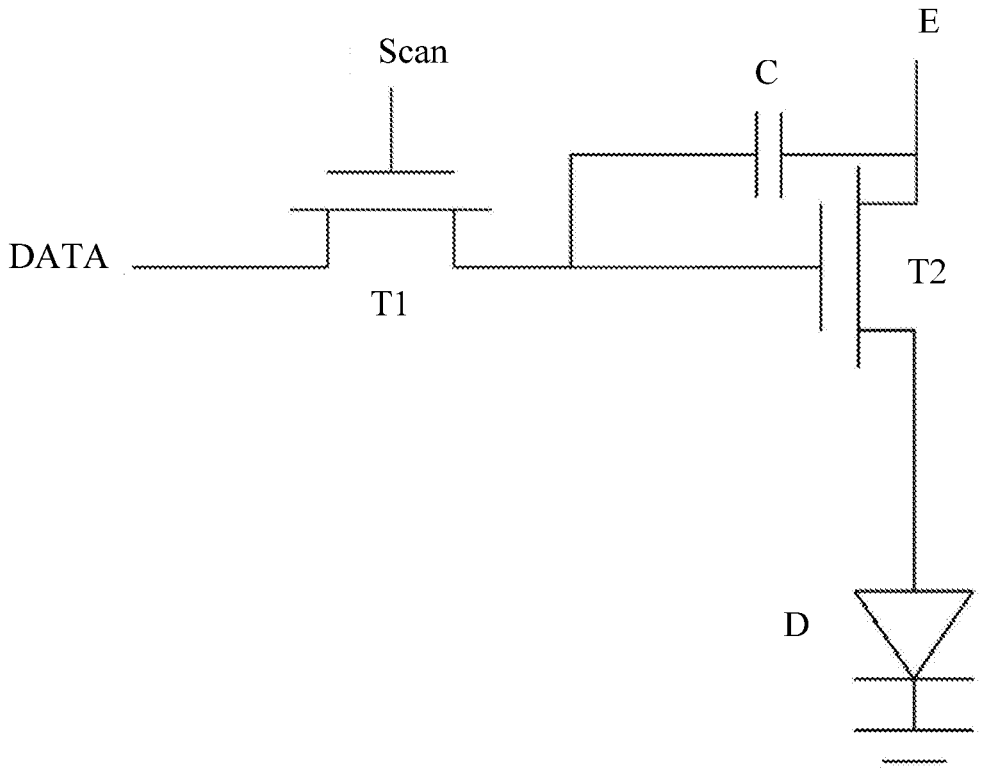
FIG. 8 is a driving circuit of a light-emitting unit of an AMOLED display device.

In a driving circuit of the light-emitting unit of the AMOLED display device, the driving current of a light-emitting unit has a correspondence relationship with the data signal voltage. Exemplarily, FIG. 8 is a driving circuit of a light-emitting unit of an AMOLED display device. As shown in FIG. 8, a light-emitting unit D is connected to a drain electrode of a thin film transistor T2, a source electrode of the thin film transistor T2 is connected to a driving power source E, and a gate electrode of the thin film transistor T2 is connected to a drain electrode of a thin film transistor T1. A source electrode of the thin film transistor T1 is connected to a data line DATA, a gate electrode of the thin film transistor T1 is connected to a scanning line Scan, and a capacitor C is connected between the drain electrode of the thin film transistor T1 and the source electrode of the thin film transistor T2. The driving circuit shown in FIG. 8 is merely an example for facilitating understanding of the present disclosure, and the actual driving circuit in the AMOLED display device can also be in other forms.

As can be seen from the current formula of thin film transistors, $$I = \frac{\mu W C_{ox}}{2L}(V_{DD} - V_{Data} - V_{th})^2, \quad (1)$$

It can be known that the driving current I of the light-emitting unit D is related to the data signal voltage VData. The driving circuit I can be changed by changing the magnitude of the data signal voltage VData. For a defective region, the current density thereof can be changed by changing the data signal voltage VData of all the light-emitting units therein, such that the current density of the defective region can be the same as that of the normal region, thereby achieving the purpose of changing the luminance of the defective region and reducing a luminance difference between the defective region and the normal region.

In the formula (1), $C_{ox}$ is a channel capacitance per unit area of the thin film transistor, μ is a channel mobility, W is a channel width of the thin film transistor, L is a channel length of the thin film transistor, and $V_{th}$ is a threshold voltage of the thin film transistor. These variables are different for different thin film transistors, but $V_{DD}$, which is a voltage of the driving power source, is a fixed value.

Figure 9:
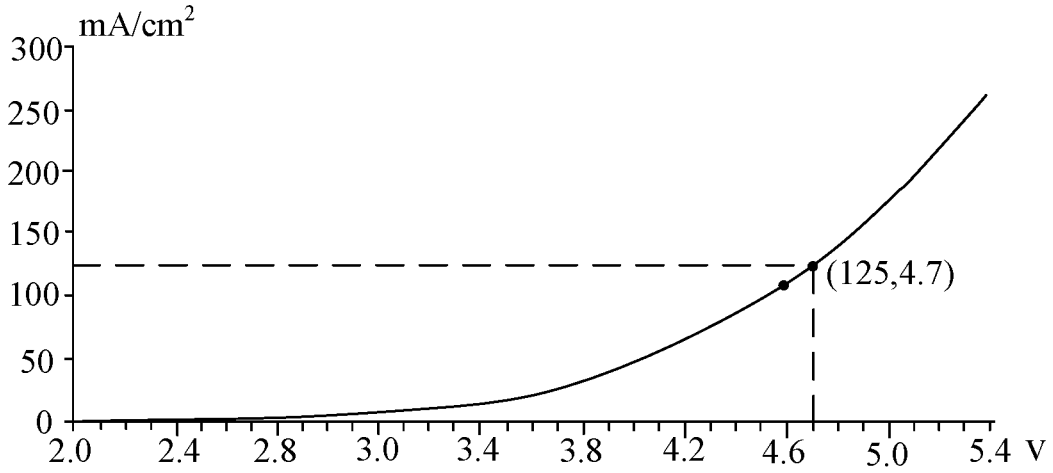
FIG. 9 is a relation curve between a data signal voltage and a current density of a poor region according to an embodiment of the present disclosure.

FIG. 9 is a relation curve between a data signal voltage and a current density of a defective region provided in an embodiment of the present disclosure. In FIG. 9, the abscissa represents data signal voltage, and the ordinate represents current density. As shown in FIG. 9, in a range of the data signal voltage VData being greater than 2.0V, with the increase of the data signal voltage VData, the current density of the defective region also increases. When the data signal voltage of the defective region is determined to acquire the correction voltage, a data signal voltage VData corresponding to the current density of the normal region can be selected from the curve as the data signal voltage of the determined defective region, i.e., the correction voltage. For example, if a current density of the normal region of a certain display device is 125 mA/cm$^2$, then the data signal voltage VData of the defective region can be set to be 4.7V, i.e., the correction voltage is set to be 4.7V. After the repair like this, the data signal voltage VData of the defective region is increased from 4.6V to 4.7V, and the current density of the defective region is increased to 125 mA/cm$^2$.

Since the area of the normal region is usually larger than the area of each defective region (as shown in FIG. 6), the number of light-emitting units in the normal region is also greater, and a sum of driving currents of the light-emitting units in the normal region is also greater than that in each defective region. By calculating a current density of the normal region and compensating the defective region according to the current density of the normal region, a sum of driving currents of the light-emitting units within an area in the normal region can be equal to a sum of driving currents of the light-emitting units within a same area in the defective region after the repair, thereby reducing a luminance difference between the original defective region and the normal region.

The comparison relationship between the current density and the data signal voltage of the defective region can be acquired by tests before the repair. The comparison relationship between the current density and the data signal voltage of the defective region can be recorded in a form of chart, so that the corresponding data signal voltage can be selected by looking up in the chart.

Exemplarily, the data signal voltage VData of the defective region can be changed for many times, and a current density of the defective region is acquired after each time the data signal voltage VData has been changed, as such, the aforementioned curve of comparison relationship between the current density and the data signal voltage of the defective region can be drawn. After each time the data signal voltage VData has been changed, the current density of the defective region can be acquired by the aforementioned acquiring device. The acquiring device can also be configured to calculate a ratio of a sum of driving currents of the light-emitting units in the defective region to an area of the defective region, thereby acquiring the current density of the defective region.

When drawing the curve of comparison relationship, the drawn curve of comparison relationship is more accurate when more data of the data signal voltage VData and current density is acquired. When drawing the curve of comparison relationship, at least the following three groups of data can be acquired: a current density of the defective region when the data signal voltage VData of the defective region is a default value (i.e., the data signal voltage before repair); a current density of the defective region when the data signal voltage VData is greater than the default value; and a current density of the defective region when the data signal voltage VData of the defective region is smaller than the default value. If the data signal voltage VData of the defective region and the current density of the defective region which have been changed for many times are recorded in one-to-one correspondence, then the aforementioned chart can be acquired.

Optionally, respective comparison relationships between the current density and the data signal voltage of the defective region can be acquired in different defective regions. Take FIG. 6 as an example. There are 7 defective regions on the screen, and the comparison relationship between current density and data signal voltage can be acquired respectively for the 7 defective regions, so as to repair the 7 defective regions respectively. It can be seen from formula (1) that the structural difference of the thin film transistors will also influence the driving current I, therefore, by acquiring the comparison relationship between current density and data signal voltage respectively for each defective region and repairing each defective region respectively, the correction voltage acquired for each defective region may be different, and thus the repair effect can be improved.

Exemplarily, a plurality of different defective regions can also be repaired only according to the comparison relationship between the current density and the data signal voltage of one of the defective regions. Take FIG. 6 as an example, it is doable to acquire only the comparison relationship between the current density and the data signal voltage of the defective region 211, and repair the 7 defective regions according to the comparison relationship between the current density and the data signal voltage of the defective region 211. If multiple different defective regions are repaired according to the comparison relationship between the current density and the data signal voltage of one of the defective regions, then the correction voltage acquired for each defective region is the same. After repair, at least the defective region 211 can be repaired well, and the other 6 defective regions may also be repaired well. After the repair has been completed, the display device can be detected again. If no defective region is found when the detection is repeated, the repair is completed; and if there is still a defective region when the detection is repeated, the defective region can be repaired again according to the comparison relationship between the current density and data signal voltage of one of the remaining defective regions. For example, after the first repair, if there are still defective regions 212 and 213, then the defective regions 212 and 213 can be repaired for a second time according to the comparison relationship between the current density and data signal voltage of the defective region 212 or 213, until all the defective regions have been repaired, and then the repair is completed. During the repair process, if a certain defective region cannot be repaired all the time, this means that the display device may have other deficiencies, such as a short circuit of thin film transistor, etc., and needs to be repaired by using other methods.

Exemplarily, it is also doable to continuously adjust (continuously increase or decrease) the data signal voltage of the defective region and acquire the current density of the defective region at real time, until the current density of the defective region is the same as that of the normal region.

Figure 10:
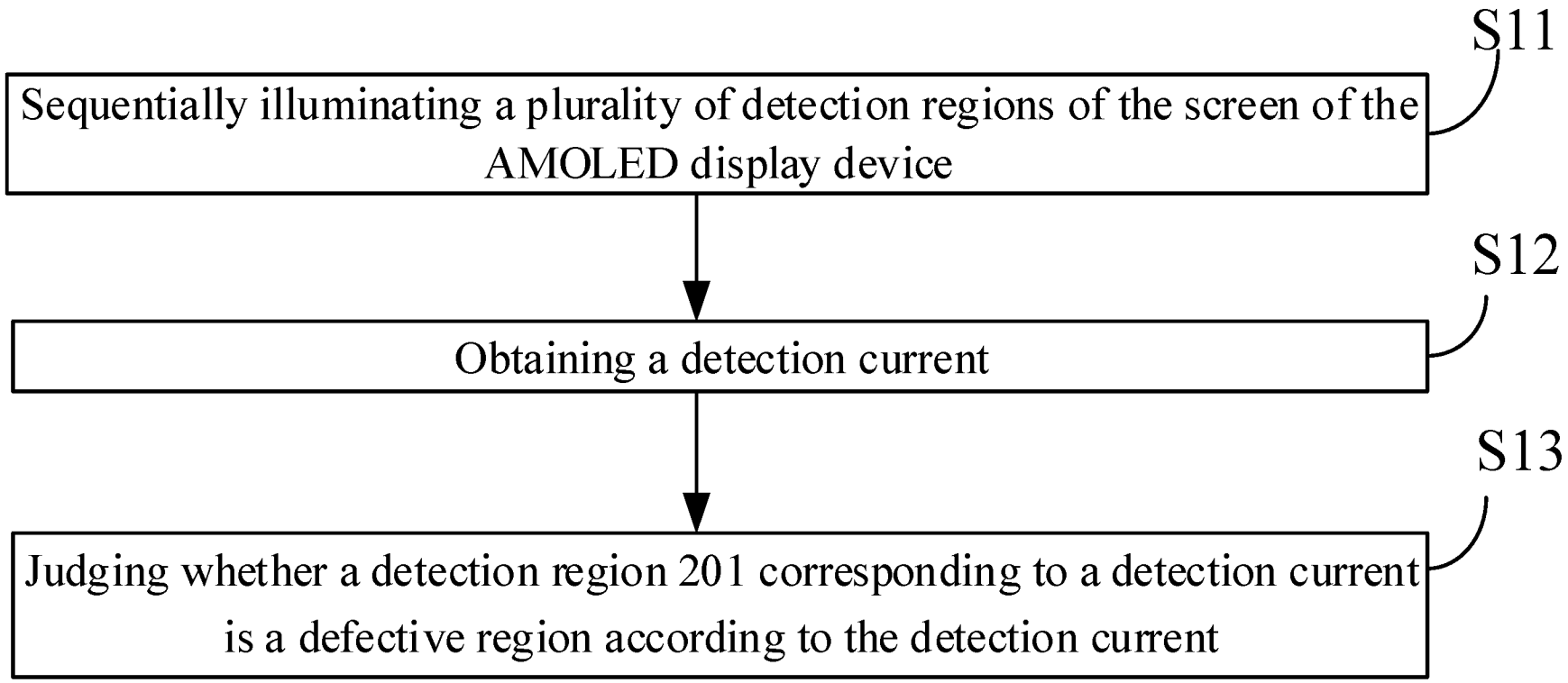
FIG. 10 is a flowchart of a detecting method of an AMOLED display device according to an embodiment of the present disclosure.

FIG. 10 is a flowchart of a detecting method of an AMOLED display device provided in an embodiment of the present disclosure. The method is configured for detecting the defective region of the screen of the AMOLED display device, and the detection can be performed by using the detecting apparatus shown in FIG. 1. As shown in FIG. 10, the detecting method comprises:

In step S11, a plurality of detection regions of the screen of the AMOLED display device are illuminated sequentially.

For example, the step S11 can be executed by the aforementioned illuminating device.

Here, the screen of the AMOLED display device is divided into a plurality of detection regions, each of which includes at least one light-emitting unit. The division of the detection regions of the screen of the AMOLED display device can be referred to FIGS. 2 and 3. As shown in FIG. 2, the plurality of detection regions are arranged in a first direction (such as X direction in FIG. 2), each of the detection regions is in a strip shape and extends in a second direction (such as Y direction in FIG. 2) perpendicular to the first direction.

When the detection regions in FIG. 2 are sequentially illuminated, a first detection region in the first direction can be illuminated first while the other detection regions are remained lighting off, then a second detection region is illuminated and all the other detection regions except the second region are remained in an lighting-off state, and thereafter a third detection region is illuminated and all the other detection regions except the third detection region are remained in an lighting-off state. As such, the detection regions are sequentially illuminated.

The screen of the AMOLED display device includes a plurality of light-emitting units distributed in an array. Here, the first direction can be a row direction of the light-emitting units distributed in an array, the second direction can be a column direction of the light-emitting units distributed in an array. In other embodiments, the first direction can also be a column direction and the second direction can also be a row direction.

As shown in FIG. 3, the plurality of detection regions can be arranged in a matrix shape.

When the detection regions in FIG. 3 are sequentially illuminated, a first detection region in the first row can be illuminated first while the other detection regions are remained in a light-off state, then a second detection region in the first row is illuminated and all the other detection regions except the second region in the first row are remained in a light-off state, and thereafter a third detection region in the first row is illuminated and all the other detection regions except the third detection region in the first row are remained in a light-off state. As such, the detection regions are sequentially illuminated.

The entire screen 200 is divided into a plurality of detection regions 201 so that the entire screen 200 can be detected, which improves the accuracy of the detection, and different division methods can be employed to satisfy different needs.

For example, for a display device with a screen length-width ratio of 24:9 or more, since the screen length-width ratio of such a display device is relatively large, the number of light-emitting units in a length direction of the screen is much greater than that in a width direction of the screen, and thus a large luminance difference is more likely to occur among different regions in the length direction. When such a display device is detected, it can be divided into a plurality of strip-shaped detection regions in the length direction of the screen, each of which extends in the width direction of the screen, such as the dividing method shown in FIG. 2. Of course, if the requirement for screen display effect is relatively high, then the screen can also be divided into a plurality of detection regions which are arranged in a matrix shape, such as the dividing method shown in FIG. 3.

When the screen size is constant, the larger the detection region is, the smaller the total number of the divided detection regions is, and the fewer the corresponding detection times are. At this point, the detection accuracy is low and the detection efficiency is high. On the contrary, the smaller the detection region is, the greater the total number of the divided detection regions is, and the more the corresponding detection times are. At this point, the detection accuracy is high and the detection efficiency is low. When the detection regions are divided, the size of the detection regions can be set according to different requirements. For a display device with a higher requirement for display effect, the detection regions can be set to be smaller, and for a display device with a lower requirement for display effect, the detection regions can be set to be larger.

Exemplarily, each detection region can include 4 to 8 pixel structures. The pixel structure of different display devices can include different numbers of light-emitting units, for example, a single pixel structure can include three light-emitting units. A single pixel structure of a certain kind of display device includes a light-emitting unit that emits red light, a light-emitting unit that emits green light and a light-emitting unit that emits blue light. When dividing the detection regions of such a display device, if each detection region includes 4 pixel structures, then each detection region includes 12 light-emitting units.

The smaller the detection region is, the fewer the number of the light-emitting units in the detection region is. When the detection region is so small that it includes only one light-emitting unit, it is equivalent to that the light-emitting units are detected one by one. In this way, the result of the detection is the most accurate, but correspondingly the detection efficiency is the lowest, and the detection cost is also high. In general, the size of each detection region is set to be a size of 4 to 8 pixel structures, so that the detection result has a relatively high accuracy to satisfy the detection requirement.

In step S12, a detection current is acquired.

Here, the detection current is a sum of driving currents of the light-emitting units in the detection regions which are illuminated.

For example, the step S12 can be executed by the aforementioned current detecting device.

In step S13, whether a detection region 201 corresponding to a detection current is a defective region is judged according to the detection current.

For example, the step S13 can be executed by the aforementioned judging device.

The screen of the AMOLED display device is divided into a plurality of detection regions, which are sequentially illuminated, and the detection currents of the detection regions are acquired. Whether a detection region is a defective region is judged according to the detection current, and in this way a detection of luminance uniformity can be performed for the AMOLED display device. As such, the detection efficiency is high, the detection standard is unified, and the accuracy is high.

Optionally, the step S13 may include: calculating a ratio of detection current to a current reference value, which is one of a set value and an average value of the detection currents of the detection regions; and determining whether a detection region is a defective region according to the ratio.

A luminance of a light-emitting unit is related to a magnitude of the driving current of the light-emitting unit. The greater the driving current is, the higher the luminance is. On the contrary, the smaller the driving current is, the lower the luminance is. By judging whether a detection region is a defective region through the ratio of the detection current to the current reference value, it is possible to accurately detect the region that is greatly different in luminance.

When the current reference value is an average value of the detection currents of the detection regions, if the detection current is closer to the current reference value, i.e., the ratio is more approximate to 1, this indicates that the light-emitting luminance of the detection region is more approximate to the average luminance of the detection regions. The smaller the luminance difference between different detection regions is, the more uniform the screen luminance is.

The set value can be set according to design requirements. For example, a corresponding set value can be set in accordance with a luminance requirement of a designed display device. If the detection current is closer to the current reference value, i.e., the ratio is more approximate to 1, this indicates that the luminance of the detection region is more approximate to the required luminance. If the detection current of every detection region is close to the current reference value, the smaller the luminance difference between different detection regions is, the more uniform the screen luminance is.

Exemplarily, when the ratio is within a range from 0.9 to 1.1, the corresponding detection region can be regarded as a normal region. When the ratio is smaller than 0.9 or greater than 1.1, the detection region is regarded as a defective region. In practice, it is hard to ensure that the detection current of the detection region is completely equal to the current reference value, so when the ratio is within a certain range, the detection region can be regarded as a normal region. The range of the ratio can be set according to different design requirements. For a display device with a higher design requirement, the range of the ratio can be set to be smaller, such as from 0.95 to 1.05, and for a display device with a lower design requirement, the range of the ratio can be set to be larger, such as from 0.8 to 1.2.

Exemplarily, it is also possible to determine whether each detection region is a defective region according to an absolute value of a difference between the detection current and the current reference value. When the absolute value of the difference between the detection current and the current reference value is smaller, the light-emitting luminance of the detection region is closer to the luminance of the other detection regions, and the smaller the luminance difference between different detection regions is, the more uniform the screen luminance is.

Optionally, after the step S13, the detecting method can also comprise a step of storing position information of the determined defective region, so as to facilitate acquirement of the position of the defective region when the defective region is repaired. The position information can be a virtual coordinate, which can be a one-dimensional coordinate or a two-dimensional coordinate. For example, if the filled region in FIG. 2 is a defective region, then the virtual coordinate (one-dimensional coordinate) of the defective region can be recorded as 1. If a detection region adjacent to the filled region is a defective region, then the virtual coordinate of the defective region can be recorded as 2. If the filled region in FIG. 3 is a defective region, then the virtual coordinate (two-dimensional coordinate) of the defective region can be recorded as (3, 3). In addition, the position information can also be a number. For example, if the plurality of detection regions divided on the screen are respectively numbered, then the position information of the defective region is the number corresponding to the defective region.

Figure 11:
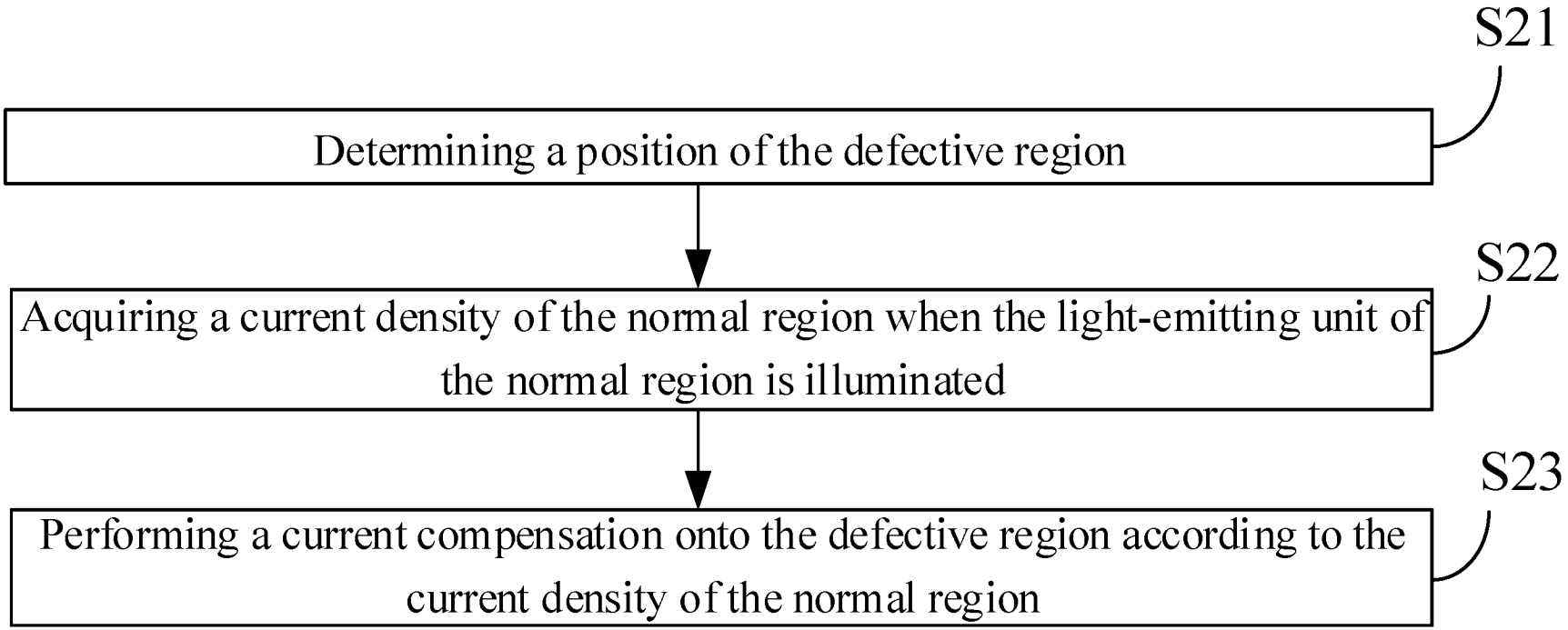
FIG. 11 is a flowchart of a repairing method of an AMOLED display device according to an embodiment of the present disclosure.

FIG. 11 is a flowchart of a repairing method of an AMOLED display device provided in an embodiment of the present disclosure. The method is configured for repairing the defective region of the screen of the AMOLED display device in which a Mura defect is present, and the repair can be performed by using the repairing apparatus shown in FIG. 5.

As shown in FIG. 11, the repairing method comprises: determining a position of the defective region in step S21.

Exemplarily, the position of the defective region can be determined according to a luminance of respective detection regions on the screen. Alternatively, the position of the defective region is determined according to a ratio between the detection current and a current reference value of each detection region on the screen. The screen is divided into a plurality of detection regions, the detection current is a sum of driving currents of the light-emitting units in the detection region which is illuminated, and the current reference value is one of a set value and an average value of the detection currents of the detection regions.

For example, a determining device 410 can be employed to detect the display device by the aforementioned detecting apparatus of the AMOLED display device, so as to determine the position of each defective region on the screen. Alternatively, a luminance meter can be employed to perform luminance detection on each region of the screen, so as to determine the position of each defective region. Alternatively, position information of each defective region can also be utilized directly through the aforementioned storage device, such that the position of each defective region is found rapidly and accurately during the repair process, which improves the repair efficiency and avoids omissions of repair.

Exemplarily, the step S21 can be executed by the aforementioned determining device.

In step S22, a current density of the normal region when the light-emitting unit of the normal region is illuminated is acquired.

The current density of the normal region can be acquired by calculating a ratio of a sum of driving currents of the light-emitting units in the normal region to an area of the normal region. The sum of driving currents of the light-emitting units of the normal region can be acquired by the aforementioned step S12 in the detecting method of an AMOLED display device.

The area of each region can be represented by a size of a plane enclosed by a profile of the region, and the unit can be square millimeter and square centimeter, etc. For example, the current density of a certain region is 3 $mA/mm^2$. In addition, since the distribution of light-emitting units on the screen is generally uniform, the area of each region can also be represented as the number of the light-emitting units in the region, and the unit can be one light-emitting unit. For example, the current density of a certain region is 5 mA per light-emitting unit.

For example, the step S22 can be executed by the aforementioned acquiring device.

In step S23, a current compensation is performed on the defective region according to the current density of the normal region.

For example, the step S23 can be executed by the aforementioned compensating device.

Exemplarily, the step S23 may include: determining a data signal voltage of the defective region according to a comparison relationship between the current density and the data signal voltage of the defective region, such that, a current density of the defective region can be equal to the current density of the normal region under the effect of the correction voltage. Here, the correction voltage is the data signal voltage of the determined defective region. This process can be executed by the aforementioned voltage determining unit in the compensating device.

The correction voltage of the defective region is entered into a driver chip of the AMOLED display device. This process can be executed by the aforementioned entering unit in the compensating device. Exemplarily, the determination process can be referred to the embodiments of the repairing apparatus of an AMOLED display device, which is not repeated here.

The embodiment of the present disclosure performs a current compensation to the defective region of the display device according to the current density of the normal region, thus a luminance of the defective region can be changed and a luminance difference between the defective region and the normal region can be reduced, which is beneficial for improving the display effect and the yield.

After the repair of the display device is completed, the display device can be detected again. If no defective region is found when the detection is repeated, it means that the repair is successful. If there is still a defective region, it means that the display device may have other deficiencies, such as a short circuit of thin film transistor, and other methods are needed to repair the display device.

Figure 12:
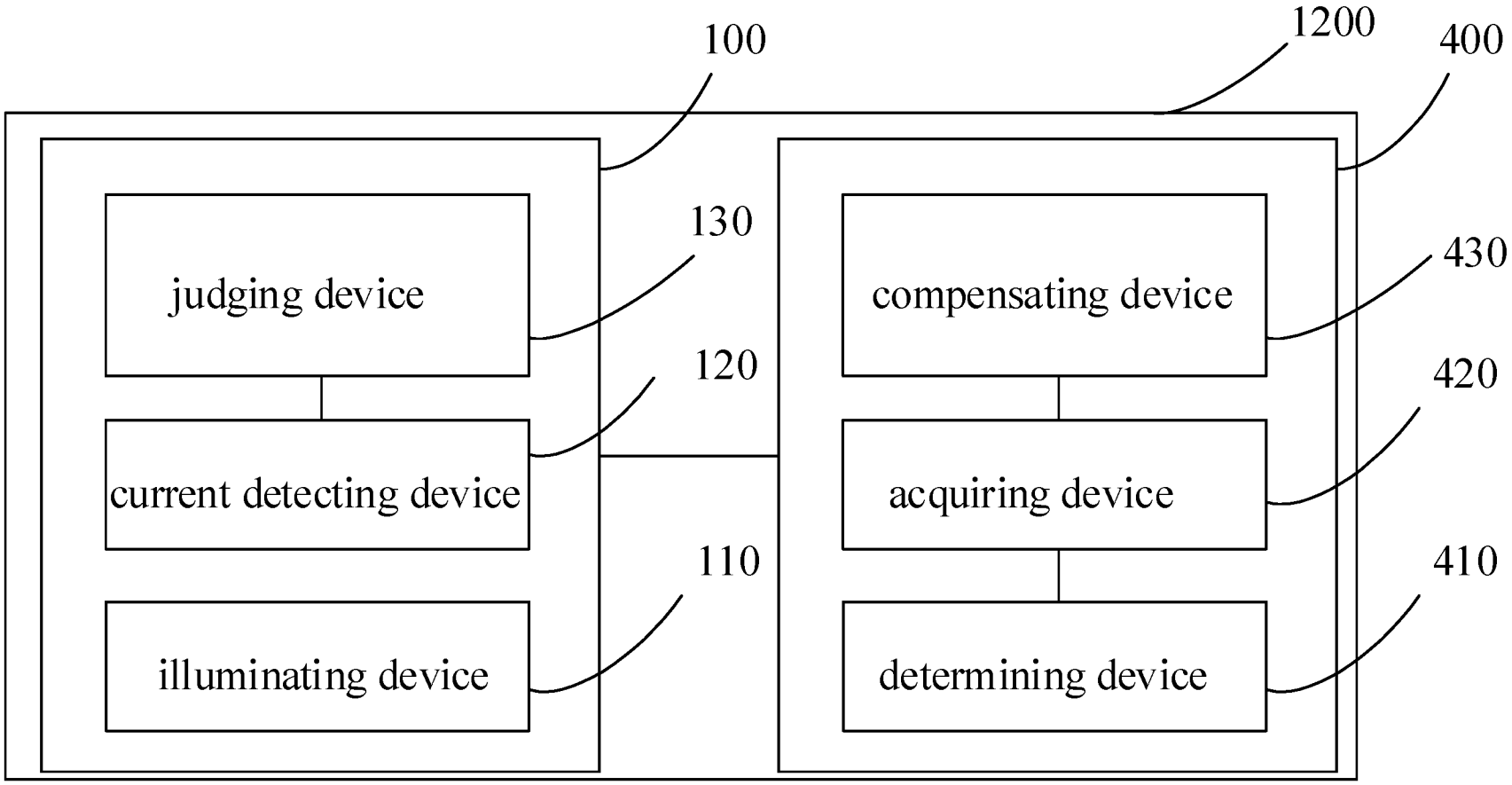
FIG. 12 is a repairing system of an AMOLED display device according to an embodiment of the present disclosure.

FIG. 12 is a repairing system of an AMOLED display device provided in an embodiment of the present disclosure. The repairing system 1200 comprises the detecting apparatus shown in FIG. 1 and the repairing apparatus shown in FIG. 5.

In the embodiments of the present disclosure, by dividing the screen of the AMOLED display device into a plurality of detection regions, sequentially illuminating the detection regions, and acquiring the detection currents of the detection regions, and then judging whether a detection region is a defective region according to the detection current, the luminance uniformity of the AMOLED display device can be detected with high detection efficiency, a unified standard and high accuracy. By performing a current compensation to the defective region of the display device according to the current density of the normal region, it is possible to change the luminance of the defective region and reduce a luminance difference between the defective region and the normal region, which is beneficial for improving the display effect and the yield.

The foregoing descriptions are merely exemplary embodiments of the present disclosure, and are not intended to limit the present disclosure. Within the spirit and principles of the disclosure, any modifications, equivalent substitutions, improvements, etc., are shall fall into the protection scope of the appended claims of the present disclosure.

What is claimed is:

1. A detecting apparatus of an Active Matrix Organic Light Emitting Diode (AMOLED) display device, comprising;

an illuminating device configured to sequentially illuminate a plurality of detection regions of a screen of the AMOLED display device, the screen being divided into the plurality of detection regions, each of the detection regions comprising at least one light-emitting unit;

a current detecting device configured to acquire a detection current which is a sum of driving currents of the light-emitting units in the detection regions being illuminated; and a judging device configured to judge whether the detection region corresponding to the detection current is a defective region according to the detection current; and wherein each of the detection regions comprises 4 to 8 pixel structures; and the plurality of detection regions are in a first direction, each of the detection regions being in a strip shape and extending in a second direction, and the second direction being perpendicular to the first direction.

2. The detecting apparatus according to claim 1, wherein the judging device comprises:

a calculating circuit configured to calculate a ratio of the detection current to a current reference value which is one of a set value and an average value of the detection currents of the detection regions; and a judging circuit configured to determine whether the detection region is a defective region according to the ratio.

3. The detecting apparatus according to claim 2, further comprising:

a storage device configured to store position information of the defective region that is determined.

4. The detecting apparatus according to claim 1 further comprising:

a determining device configured to determine positions of the defective regions;

an acquiring device configured to acquire a current density of a normal region when light-emitting unit in the normal region is illuminated, the normal region being a region other than the defective regions on the screen of the AMOLED display device; and a compensating device configured to perform current compensation on the defective regions based on the current density of the normal region.

5. The detecting apparatus according to claim 4, wherein the determining device is configured to determine the position of the defective regions in any of the following ways:

determining the positions of the defective regions based on luminance of respective detection regions on the screen;

determining the positions of the defective regions based on a ratio of detection current of respective detection regions to a current reference value, the screen being divided into a plurality of detection regions, the detection current being a sum of driving currents of light-emitting units in the detection regions being illuminated, and the current reference value being one of a set value and an average value of the detection currents of the detection regions; and determining the positions of the defective regions based on position information of the defective regions.

6. The detecting apparatus according to claim 4, wherein the acquiring device is configured to calculate a ratio of a sum of driving currents of the light-emitting units in the normal region to an area of the normal region, so as to acquire the current density of the normal region.

7. The detecting apparatus according to claim 4, wherein the compensating device comprises:

a voltage determining unit configured to determine a data signal voltage of the defective regions based on a comparison relationship between the current density and the data signal voltage of the defective regions, such that the current density of the defective regions is equal to the current density of the normal region under effect of a correction voltage, the correction voltage being the data signal voltage of the defective regions being determined; and an entering unit configured to enter the correction voltage of the defective regions into a driver chip of the AMOLED display device.

8. A detecting method of an Active Matrix Organic Light Emitting Diode (AMOLED) display device, comprising the following steps:

sequentially illuminating a plurality of detection regions of a screen of the AMOLED display device, the screen being divided into the plurality of detection regions, each of the detection regions comprising at least one light-emitting unit;

acquiring a detection current which is a sum of driving currents of the light-emitting units in the regions being illuminated; and judging whether the detection region corresponding to the detection current is a defective region according to the detection current; and wherein each of the detection regions comprises 4 to 8 pixel structures; and the plurality of detection regions are in a first direction, each of the detection regions being in a strip shape and extending in a second direction, and the second direction being perpendicular to the first direction.

9. The detecting method according to claim 8, wherein the step of judging whether the detection region corresponding to the detection current is the defective region according to the detection current comprises:

calculating a ratio of the detection current to a current reference value which is one of a set value and an average value of the detection currents of the detection regions; and determining whether the detection region is a defective region according to the ratio.

10. The detecting method according to claim 9, further comprising:

storing position information of the defective regions being determined.

11. The detecting method according to claim 8 further comprising the following steps:

determining positions of the defective regions;

acquiring a current density of a normal region when the light-emitting unit in the normal region is illuminated, the normal region being a region other than the defective regions on the screen of the AMOLED display device; and performing current compensation on the defective region according to the current density of the normal region.

12. The detecting method according to claim 11, wherein the step of determining a position of the defective regions is performed in any of the following ways:

determining the positions of the defective regions based on luminance of respective detection regions on the screen;

determining the positions of the defective regions based on a ratio of detection current of respective detection regions to a current reference value, the screen being divided into a plurality of detection regions, the detection current being a sum of driving currents of the light-emitting units in the detection regions that are illuminated; and the current reference value being one of a set value and an average value of the detection currents of the detection regions; and determining the positions of the defective regions based on position information of the defective regions.

13. The detecting method according to claim 11, wherein the step of acquiring a current density of a normal region comprises:

calculating a ratio of a sum of driving currents of the light-emitting units in the normal region to an area of the normal region, so as to acquire the current density of the normal region.

14. The detecting method according to claim 11, wherein the step of performing current compensation on the defective region according to the current density of the normal region comprises:

determining data signal voltage of the defective regions based on a comparison relationship between the current density and the data signal voltage of the defective regions, such that the current density of the defective regions is equal to the current density of the normal region under effect of a correction voltage which is the data signal voltage of the defective regions being determined; and entering the correction voltage of the defective regions into a driver chip of the AMOLED display device.

15. The detecting method according to claim 11, further comprising:

performing a luminance uniformity detection on the AMOLED display device after performing the current compensation to the defective region based on the current density of the normal region.

16. A repairing system of an Active Matrix Organic Light Emitting Diode (AMOLED) display device, comprising a detecting apparatus and a repairing apparatus, wherein the detecting apparatus comprises:

an illuminating device configured to sequentially illuminate a plurality of detection regions of a screen of the AMOLED display device, the screen being divided into the plurality of detection regions, each of the detection regions comprising at least one light-emitting unit;

a current detecting device configured to acquire a detection current, and the detection current is a sum of driving currents of the light-emitting units in the detection regions that are illuminated; and a judging device configured to judge whether the detection region corresponding to the detection current is a defective region based on the detection current;

wherein the repairing apparatus comprises:

a determining device configured to determine positions of the defective regions based on position information of the defective regions;

an acquiring device configured to acquire a current density of a normal region when the light-emitting unit in the normal region is illuminated, the normal region being a region other than the defective regions on the screen of the AMOLED display device; and a compensating device configured to perform current compensation on the defective regions based on the current density of the normal region; and wherein each of the detection regions comprises 4 to 8 pixel structures; and the plurality of detection regions are in a first direction, each of the detection regions being in a strip shape and extending in a second direction, and the second direction being perpendicular to the first direction.

* * * * *